United States Patent [19]

DeGraaf

[11] 4,135,543

[45] Jan. 23, 1979

[54] HOSE STORAGE AND SUPPLY APPARATUS

[75] Inventor: Douglas W. DeGraaf, Downers Grove, Ill.

[73] Assignee: Chicago Bridge & Iron Company, Oak Brook, Ill.

[21] Appl. No.: 852,329

[22] Filed: Nov. 17, 1977

[51] Int. Cl.[2] ..... B67D 5/00

[52] U.S. Cl. ..... 137/236 S; 137/355.17; 137/355.2; 137/615; 141/388

[58] Field of Search ..... 137/236, 355.16, 355.17, 137/355.2, 355.21, 355.22, 355.23, 355.24, 355.25, 373, 615; 141/338; 9/8 P

[56] References Cited

U.S. PATENT DOCUMENTS

| | | | |
|---|---|---|---|
| 2,545,063 | 3/1951 | Wolfe | 137/355.2 |
| 3,884,528 | 5/1975 | Shaddock | 137/355.24 X |

*Primary Examiner*—Gerald A. Michalsky

*Attorney, Agent, or Firm*—Merriam, Marshall & Bicknell

[57] ABSTRACT

A hose storage and supply apparatus comprising a hose guide track having front and rear ends, the guide track having means on which a hose can move as it is paid out or is retracted, a hose on the guide track, a fluid coupling means joined to each end of the hose on the guide track for joining a fluid supply conduit thereto, and means operably connected to the hose to move it along the guide track from a retracted position to a paid out position and back to a retracted position.

21 Claims, 7 Drawing Figures

HOSE STORAGE AND SUPPLY APPARATUS

This invention relates to fluid transfer apparatus and methods. More particularly, this invention is concerned with apparatus and methods for the storage and supply of large size hose.

The filling and emptying of a moored oil tanker or ship generally requires that one or more flexible conduits or hoses be releasably connected to the ship and extend from it to a loading or unloading facility, such as a dock in a conventional port, offshore port, or offshore platform. A flexible conduit is needed to accommodate changes in the position of the ship caused by tides, wind and sea currents. As the size of oil tankers increased in recent years, it became necessary to use larger flexible conduits or hoses to load and unload in a reasonable period of time. The handling of a large hose, such as one 8 to 24 inches in diameter or larger, requires mechanical assistance because of its weight and size in stringing the hose from a port or other mooring facility to a ship and back again. When not in use the hose must be stored in such a way that it can be supplied or paid out readily when needed.

There has been in use for sometime a hose handling system for loading an oil tanker from an offshore tower or platform. In this system an oil pipe flow line extends from the tower to a boom and extends to the boom end about 140 feet from the tower. At this point an elbow directs the oil vertically downward through a fluid swivel and into a flanged hose end. The hose exits the boom through a bell mouth which limits the minimum bend radius of the hose. The hose continues downward to a point approximately 30 feet beneath the water surface. The hose has a fluid transfer end connector for quick connection to a ship receiver. During the period of time when a ship is not loading, the hose hangs vertically and extends into the water. Handling lines extend to the hose end as well as a mooring hawser. A disadvantage of the described system is that it is cumbersome to operate, lines get tangled, and there is always the danger of the tanker or work boats interfering with or damaging the hose.

According to the invention, there is provided a hose storage and supply apparatus comprising a hose guide track having front and rear ends, the quide track having means on which a hose can move as it is paid out or is retracted, a hose on the guide track, a fluid coupling means joined to each end of the hose on the guide track for joining a fluid supply conduit thereto, and means operably connected to the hose to move it along the guide track from a retracted position to a paid out position and back to a retracted position. Desirably, the guide track is arched and lies in a vertical plane. A particularly suitable means on which the hose can move is a plurality of rollers.

More specifically, the present invention provides a hose storage and supply apparatus comprising a hose guide track having front and rear ends, the guide track having means on which a hose can move as it is paid out or is retracted, a trolley adapted to move along the guide track, a fluid coupling means on the trolley joined to the end of a hose on the guide track and having means for a fluid supply conduit to be connected thereto, and means operably joined to the trolley to force it along the guide track to pull the hose thereon from a paid out to a retracted position. In this embodiment employing a trolley, the means on which the hose can move can be a plurality of rollers for effecting ready rolling movement of the hose. The guide track is generally arched, such as a segment of a circle, and placed in a vertical plane. Such a guide track can store sufficient hose which when paid out permits the hose to be attached to a ship tanker without splicing in additional hose sections.

The fluid supply conduit of the apparatus advisably includes a conduit extending from the trolley to a fluid swivel radially positioned relative to the guide track. In this way fluid can be supplied to the hose whether none or up to all of the hose is paid out from the guide track.

Each side of the hose guide track is desirably provided with a runway or channel in which wheels on the trolley are positioned to thereby movably secure the trolley on the guide track. Also, a winch can be positioned at the rear end of the guide track and a line extended from the winch to the trolley to pull the trolley and the hose along the guide track towards the winch when the hose is to be retracted. When the hose is paid out the line can be supported by the guide track, desirably in grooves placed in at least the rollers contacted by the line.

The hose guide track is usually mounted on support means, such as an offshore tower or platform by, and higher than, a body of water and the guide track front end positioned to extend over the water. A hose bell can be located at the front end of the guide track and the hose extended through the hose bell and maintained therein even when the hose is fully retracted. Desirably, the hose fully retracted is of such length that a portion hangs vertically downwardly from the bell for a suitable distance so that the hose can be horizontally pulled to a moored ship very readily because of the initial smooth curve made in the hose by such pulling.

The invention will be described further in conjunction with the attached drawings, in which.

So far as is practical, the same elements or parts which appear in the different views of the drawings will be identified by the same numbers.

Figure 1:
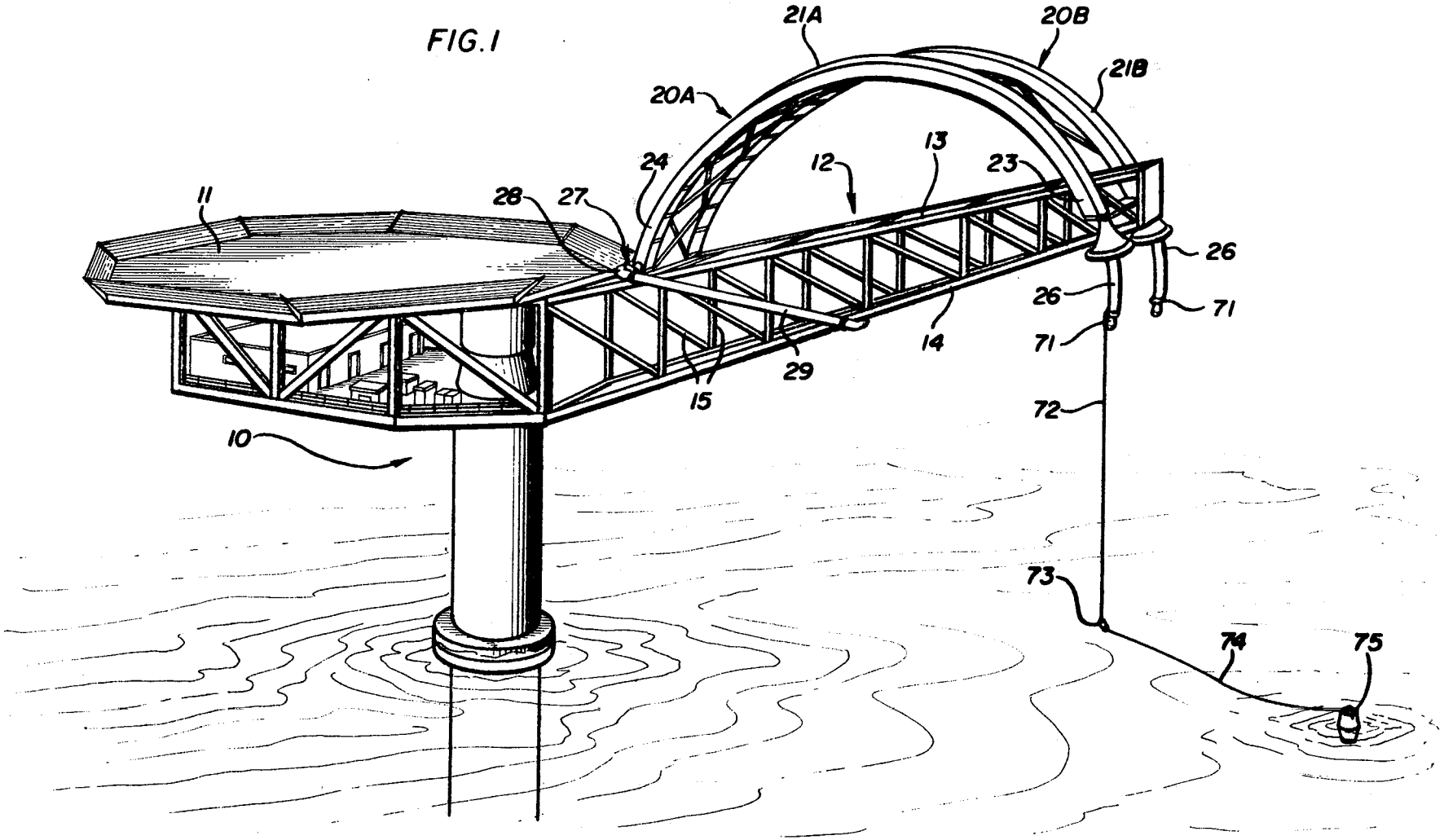
FIG. 1 is an isometric view of an offshore tower having two hose storage and supply apparatus mounted on a boom for transferring oil to a tanker.

The offshore tower 10 shown in FIG. 1 rests on the sea floor. The tower is provided with a helicoper landing port 11 and an outwardly and upwardly extending boom 12. The boom 12 is an open framework structure having top and bottom chords 13 and 14 to which trusses and cross-braces 15 are joined thus forming a strong structure having low wind resistance.

Mounted on the boom 12 is a pair of hose storage and supply apparatus 20A and 20B which are essentially identical. Although only one such hose storage and supply apparatus 20A or 20B need be employed for loading oil, it is sometimes advisable to have two such apparatus available in case one of them is broken or out of service, or to speed up loading of a tanker with oil by simultaneous use of both of the hose storage and supply apparatus.

Since the two hose storage and supply apparatus 20A and 20B are essentially identical as shown in the drawings, being mirror images of each other, only the apparatus 20A will be described, it being understood that the same description and elements, and the same identifying numbers for the same or essentially similar elements, applies to the second apparatus 20B.

The two hose storage and supply apparatus 20A and 20B are arched upwardly in the general shape of a segment of a circle and they contain respectively hose guide tracks 21A and 21B which are in spaced-apart fixed position relative to one another. Each arched guide track is in a vertical plane. Cross bracing or bridging 22 holds the two guide tracks 21A and 21B in fixed position.

The hose guide track 21A has a front end 23 and a rear end 24 joined to the boom 12. The guide track 21A supports a plurality of side-by-side rollers 25 on which the hose 26 can roll as it is paid out or retracted. A trolley 27 is mounted on the hose guide track 21A. A pipe connection or elbow 28 is joined to the trolley and the inner end of the hose 26 is joined to the pipe elbow 28. The upper end of a pipe 29 is joined by a swivel fluid connection 30 to a pipe elbow 28. The lower end of a pipe 29 is joined by a swivel fluid connection 31 to a pipe 32 which is in valved communication with a supply of fluid, such as oil to be pumped to an oil tanker. The pipe 29 thus is able to pivot about the swivel connection 31 in a clockwise manner as the hose is paid out and the trolley 27 moves from the position shown in FIG. 2 to the position shown in FIG. 3.

Figure 5:
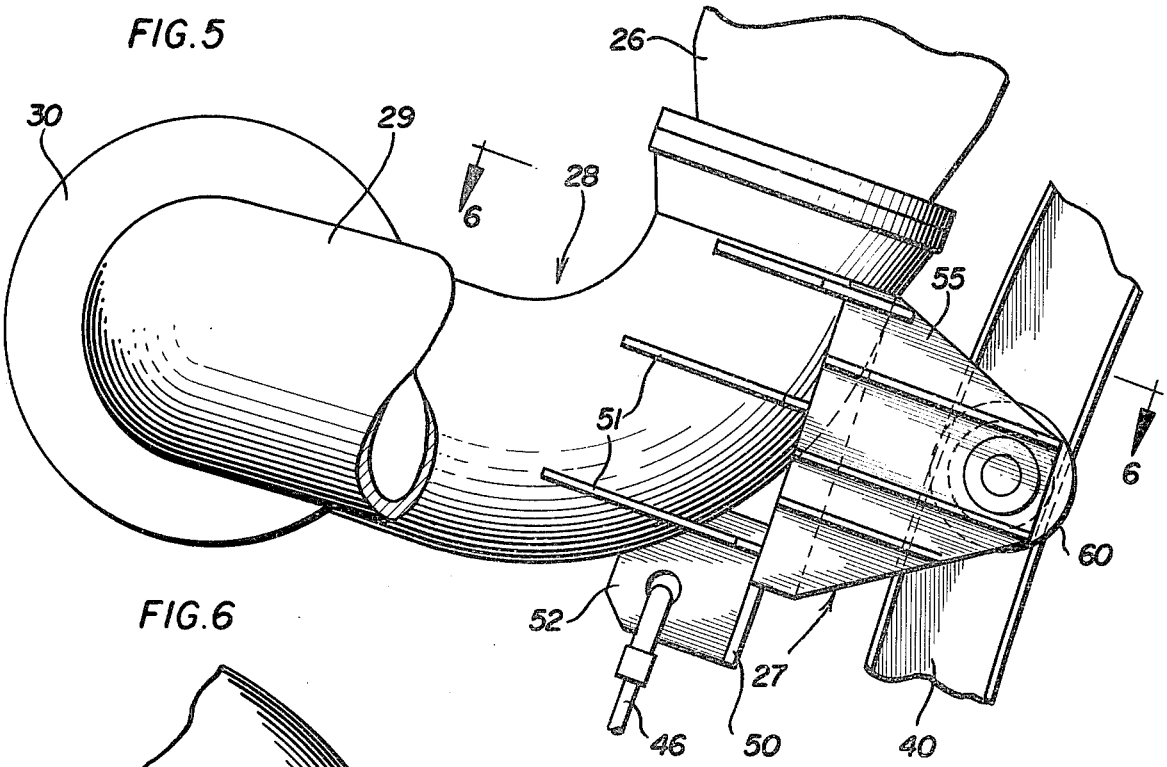
FIG. 5 is a side-elevational view of a guided trolley supporting a pipe elbow connected or coupled to the hose and to a swivel connection for joining to a fluid supply pipe.
Figure 6:
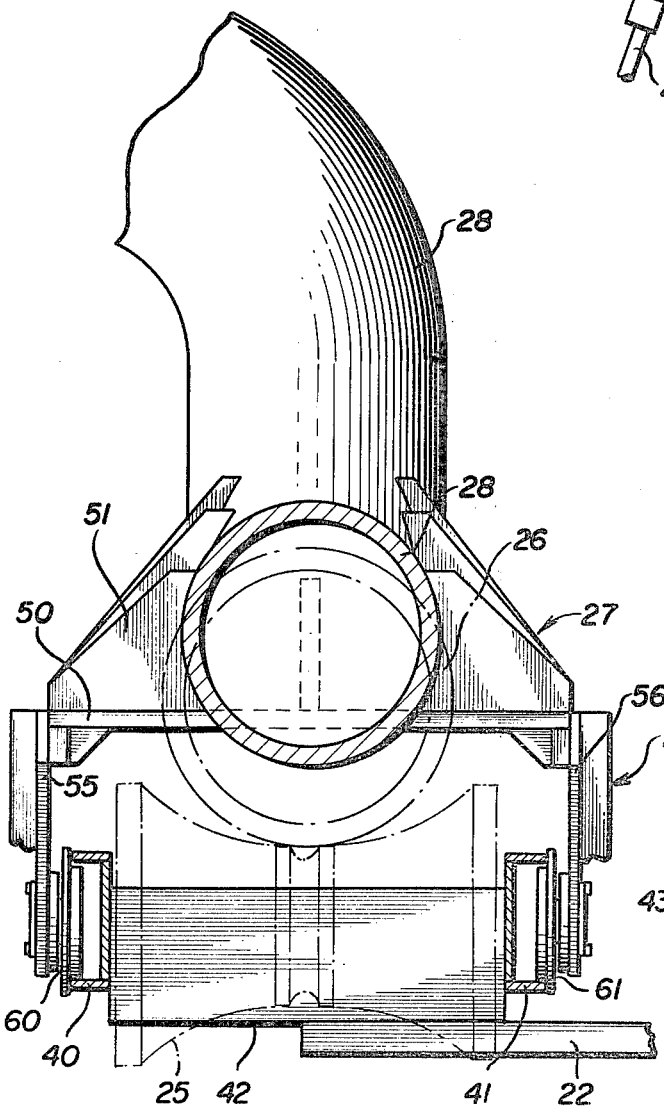
FIG. 6 is a sectional view taken along the line 6—6 of FIG. 5.
Figure 7:
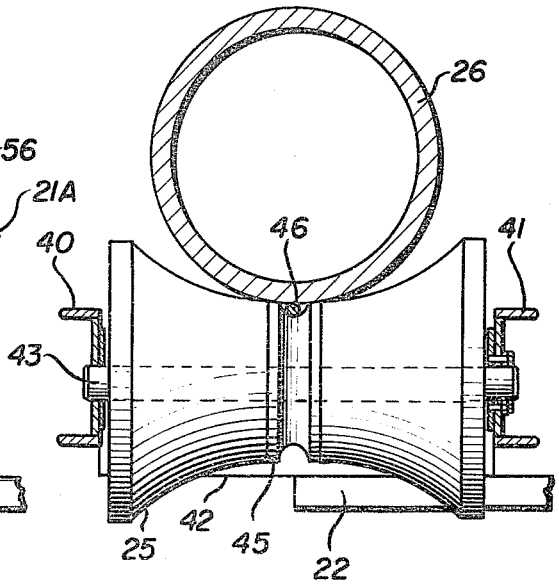
FIG. 7 is a sectional view taken along the line 7—7 of FIG. 2.

With reference to FIGS. 5 to 7, the guide track 21A includes a pair of spaced-apart circularly arched channel members 40 and 41 which are held in position by cross-braces 42 located between rollers 25. Each roller 25 rotates freely on an axle 43, the ends of which are supported in suitable bearings mounted in the arched channel members 40 and 41. The rollers 25 may be made of a suitable polymeric material such as nylon or the rollers may be made of metal. When the rollers are made of a polymeric material a central steel sheave section 45 desirably is provided for the wire rope 46 to ride in since the polymeric material could be worn too quickly by the wire rope. One end of the wire rope 46 is connected to a trolley 27 (FIG. 5) and the other end is wound onto a spool on a winch 47.

The trolley 27 has a horizontal plate 50 which is joined to pipe elbow 28 by vertical plates 51 and 52. The wire rope 56 is joined to a vertical plate 52. Extending downwardly from horizontal plate 50 are legs 55 and 56. A flanged wheel 60 is rotatably mounted at the end of a leg 55 and fits into the runway formed by a channel 40. Similarly, a flanged wheel 61 is rotatably mounted on the end of a leg 56 to fit into the runway formed by a channel 41. The two wheels 60 and 61 hold the trolley 27 on the guide track 21A as it moves from one end thereof to the other end.

Figure 2:
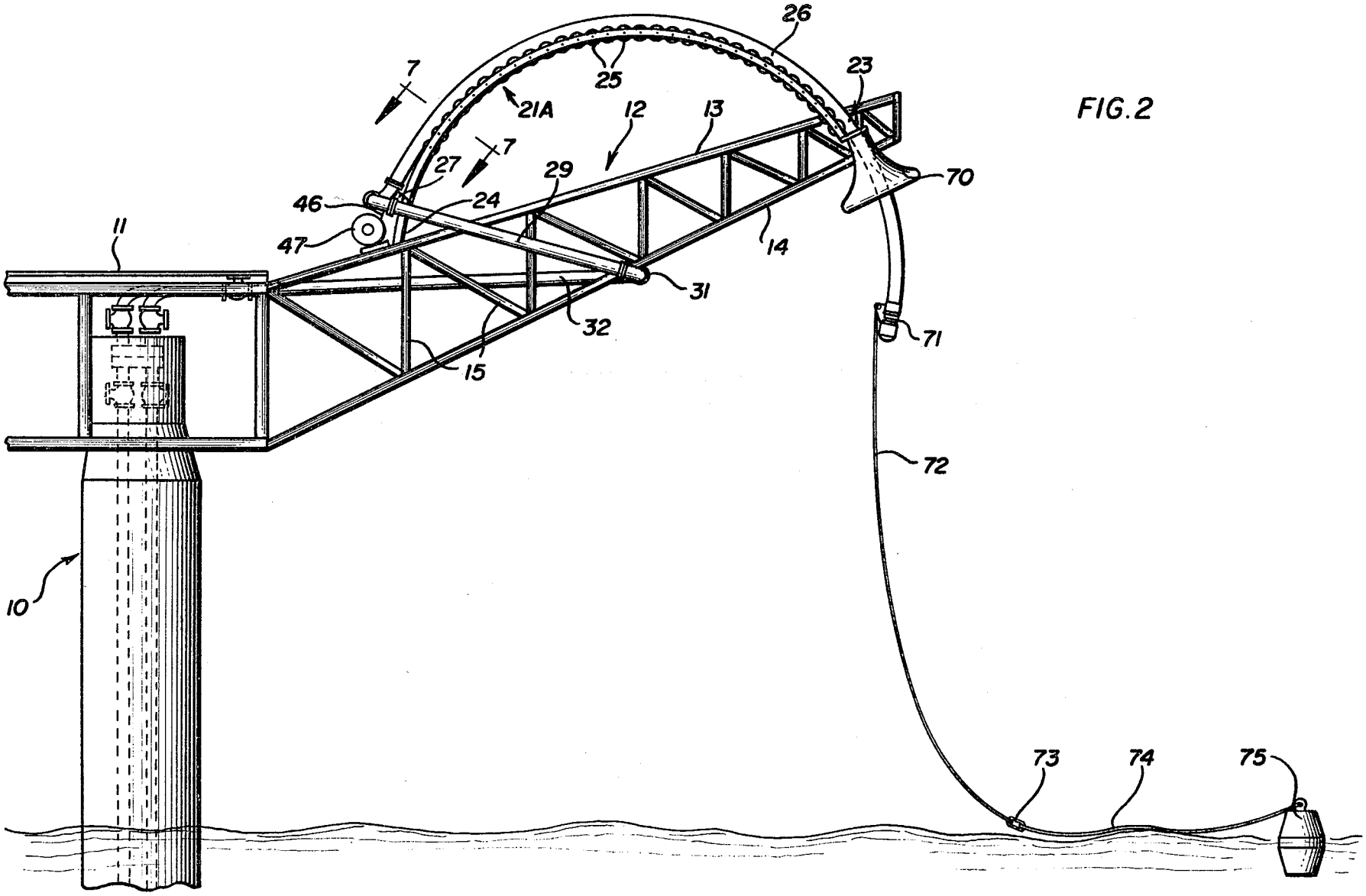
FIG. 2 is a side-elevational view of the hose storage and supply apparatus shown in FIG. 1 with the hoses fully retracted.
Figure 3:
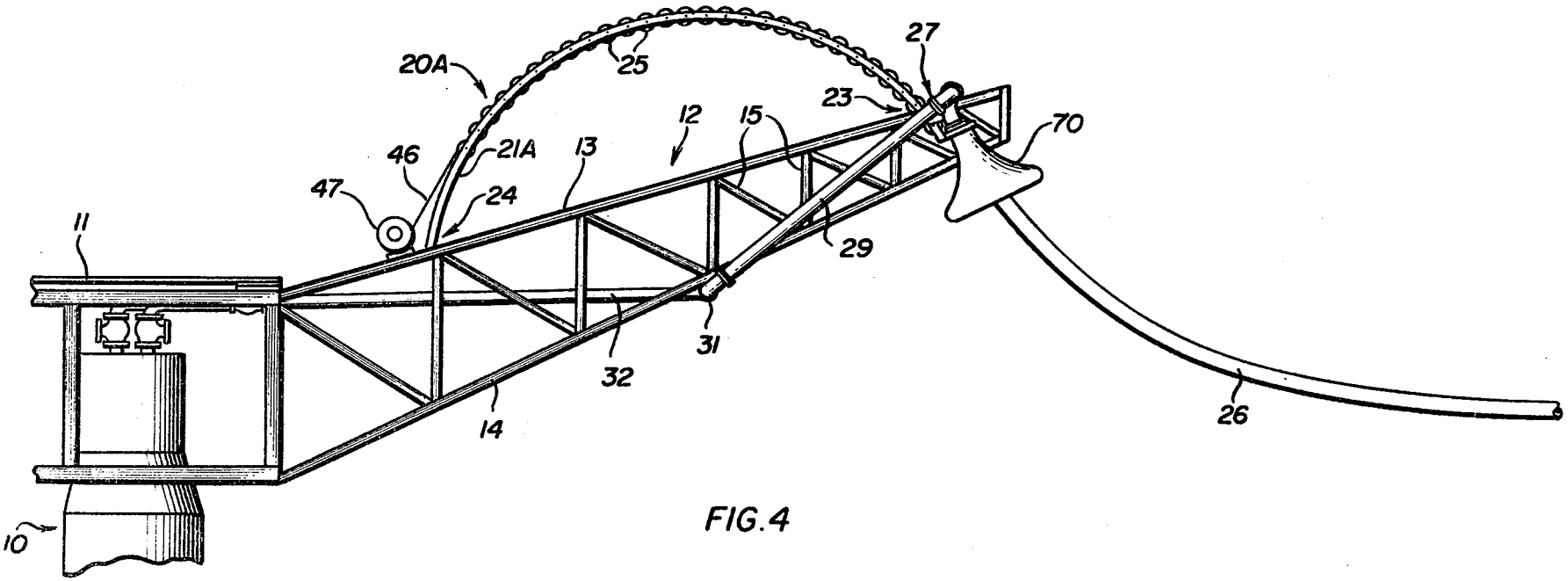
FIG. 3 is a side-elevational view of the hose storage and supply apparatus of FIGS. 1 and 2 with one of the hoses fully extended.
Figure 4:
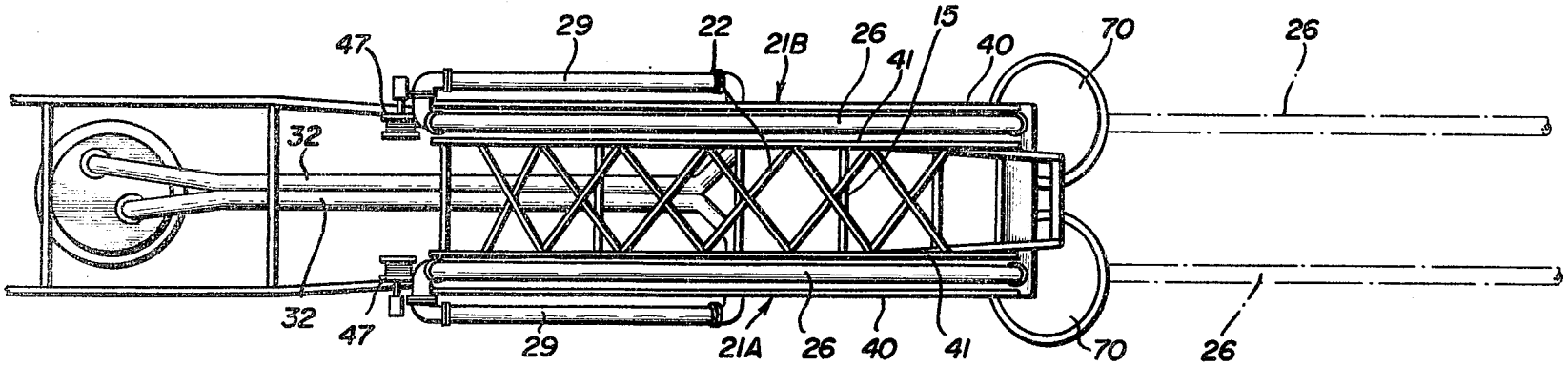
FIG. 4 is a plan view of the two hose storage and supply apparatus as shown in FIGS. 1 and 2 with the hoses retracted.

When the hose 26 is not in use delivering oil to a tanker, it will be in the fully retracted position shown in FIGS. 1 and 2 with the trolley 27 located all the way to the rear end of the hose guide track 21A and positioned close to the winch 47. The outer end of the hose 26 in the fully retracted position extends downwardly through a hose bell 70. A hose connector or coupling 71 is mounted at the end of the hose 26 and extending downwardly from it is a hawser 72 having a connector 73 at the end. A messenger line 74 is joined to one end to a connector 73 and at its other end to a float 75. When it is intended to use only one of the two hoses 26 at one time, only the hose to be used will, generally, be provided with hawser 72, messenger line 74 and float 75 shown in FIG. 1.

To connect the hose 26 to an oil tanker, the messenger line 74 will be pulled aboard the deck of an oil tanker, bringing with it the hawser 72. The hawser 72 will then be connected to a winch and power applied to pull the hose 26 forward, to bring the hose coupling 71 onto the tanker deck, so that it can be joined to a complementary fitting mounted on the tanker. As the hose 26 is pulled forward, the pipe 29 rotates about the swivel 31 and the trolley 27 moves from its position shown in FIG. 2 to the position shown in FIG. 3 where it is automatically stopped by a suitable barrier. As the trolley 27 moves along the guide track 21A in the described manner, the wire rope 46 is unwound from the winch 47 and it travels along a path described by the tops of the succession of sheaves 45 in the rollers 25. After the tanker has been loaded with oil the hose 26 is disconnected from the tanker and the hawser 72 is freed and dropped overboard. The hose 26 is then retracted onto the guide track 21A by use of a winch 47 which rewinds the wire rope 46 and in doing so pulls the hose 26 onto rollers 25 and into the retracted hose storage position shown in FIGS. 1 and 2.

Although the embodiment of the invention illustrated by the drawings includes a trolley it is to be understood that the broad concept of the invention considers the trolley as highly desirable but not essential. By proper alignment of the wire rope 46 and a direct connection to a suitable means on the rear or back end of the hose 26, the hose can be pulled back along the rollers to a retracted position. Furthermore, the pipe 29 and the swivel connections at each end can be replaced by other conduit means for delivering a fluid to the hose 26. Thus, the rear end of the hose 26 can have a coupling by which it can be joined to some other suitable fluid supply conduit on the tower which permits ready pay out of the hose 26.

The foregoing detailed description has been given for clearness of understanding only, and no unnecessary limitations should be understood therefrom, as modifications will be obvious to those skilled in the art.

What is claimed is:

1. A hose storage and supply apparatus comprising:
- a hose guide track having front and rear ends,
- the guide track having means on which a hose can move as it is paid out or is retracted,
- a trolley adapted to move along the guide track,
- a fluid coupling means on the trolley joined to the end of a hose on the guide track and having means for a fluid supply conduit to be connected thereto, and
- means operably joined to the trolley to force it along the guide track to pull the hose thereon from a paid out to a retracted position.

2. A hose storage and supply apparatus according to claim 1 in which the guide track is arched and lies in a vertical plane.

3. A hose storage and supply apparatus according to claim 2 including a winch at one end of the guide track and a line extending from the winch to the trolley to pull the trolley along the guide track towards the winch.

4. A hose storage and supply apparatus according to claim 3 in which the line is supported by the guide track when the hose is paid out.

5. A hose storage and supply apparatus according to claim 2 in which the hose guide track is mounted on support means by, and higher than, a body of water and the guide track front end extends over the water.

6. A hose storage and supply apparatus according to claim 5 in which the support means is an offshore tower or platform.

7. A hose storage and supply apparatus according to claim 1 in which the guide track is a segment of a circle and lies in a vertical plane.

8. A hose storage and supply apparatus according to claim 7 in which the fluid supply conduit includes a conduit extending from the trolley to a fluid swivel radially positioned relative to the guide track.

9. A hose storage and supply apparatus according to claim 1 in which a runway is on each side of the hose guide track and wheels on the trolley are positioned in the runways thereby movably securing the trolley on the guide track.

10. A hose storage and supply apparatus according to claim 1 in which a hose bell is located at the front end of the guide track and the hose extends through the hose bell when fully retracted on the guide track.

11. A hose storage and supply apparatus comprising:
a hose guide track having front and rear ends,
the guide track having a plurality of rollers on which a hose can roll as it is paid out or is retracted,
a trolley adapted to move along the guide track,
a fluid coupling means on the trolley joined to the end of a hose on the guide track and having means for a fluid supply conduit to be connected thereto, and
means operably joined to the trolley to force it along the guide track to pull the hose thereon from a paid out to a retracted position.

12. A hose storage and supply apparatus according to claim 11 in which the guide track is arched and lies in a vertical plane.

13. A hose storage and supply apparatus according to claim 12 including a winch at one end of the guide track and a line extending from the winch to the trolley to pull the trolley along the guide track towards the winch.

14. A hose storage and supply apparatus according to claim 13 in which the line is supported by the guide track when the hose is paid out.

15. A hose storage and supply apparatus according to claim 14 in which at least some of the rollers have grooves in which the line can ride.

16. A hose storage and supply apparatus according to claim 12 in which the hose guide track is mounted on support means by, and higher than, a body of water and the guide track front end extends over the water.

17. A hose storage and supply apparatus according to claim 16 in which the support means is an offshore tower or platform.

18. A hose storage and supply apparatus according to claim 11 in which the guide track is a segment of a circle and lies in a vertical plane.

19. A hose storage and supply apparatus according to claim 18 in which the fluid supply conduit includes a conduit extending from the trolley to a fluid swivel radially positioned relative to the guide track.

20. A hose storage and supply apparatus according to claim 11 in which a runway is on each side of the hose guide track and wheels on the trolley are positioned in the runways thereby movably securing the trolley on the guide track.

21. A hose storage and supply apparatus according to claim 11 in which a hose bell is located at the front end of the guide track and the hose extends through the hose bell when fully retracted on the guide track.

* * * * *